US006540172B2

(12) United States Patent
Flamm et al.

(10) Patent No.: US 6,540,172 B2
(45) Date of Patent: Apr. 1, 2003

(54) METHOD AND DEVICE FOR PRODUCING RANDOM WINDING CHEESES

(75) Inventors: Franz-Josef Flamm, Stolberg (DE); Christian Sturm, Krefeld (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/844,718

(22) Filed: Apr. 27, 2001

(65) Prior Publication Data

US 2002/0011538 A1 Jan. 31, 2002

(30) Foreign Application Priority Data

Apr. 27, 2000 (DE) ..... 100 20 664

(51) Int. Cl.[7] ..... B65H 54/38; B65H 54/52

(52) U.S. Cl. ..... 242/477.5; 242/477.6; 242/477.8; 242/486.4

(58) Field of Search ..... 242/477.5, 477.8, 242/477.6, 483.5, 486.4

(56) References Cited

U.S. PATENT DOCUMENTS

| | | | | |
|---|---|---|---|---|
| 749,501 A | | 11/1969 | Walden | |
| 4,026,482 A | * | 5/1977 | Rebsamen | 242/477.6 |
| 4,325,517 A | | 4/1982 | Schippers et al. | 242/477.2 |
| 4,498,637 A | | 2/1985 | Yamamoto et al. | 242/477.2 |
| 5,344,090 A | * | 9/1994 | Nakai et al. | 242/483.5 X |
| 5,577,676 A | * | 11/1996 | Berger et al. | 242/477.6 X |
| 5,639,037 A | * | 6/1997 | Marangone et al. | 242/477.8 X |
| 5,794,867 A | * | 8/1998 | Hermanns et al. | 242/477.2 |
| 6,206,320 B1 | * | 3/2001 | Kusters et al. | 242/477.8 X |

FOREIGN PATENT DOCUMENTS

| | | |
|---|---|---|
| DE | 1 161 505 | 7/1964 |
| DE | OS 2 150 301 | 4/1973 |
| DE | 36 16 362 | 11/1987 |
| DE | 43 36 312 A1 | 4/1995 |
| DE | 198 29 597 A1 | 1/2000 |
| JP | 3-115064 | 5/1991 |

OTHER PUBLICATIONS

German Search Report.

* cited by examiner

*Primary Examiner*—Kathy Matecki
*Assistant Examiner*—Minh-Chau Pham
(74) *Attorney, Agent, or Firm*—Kennedy Covington Lobdell & Hickman, LLP

(57) ABSTRACT

A method for producing cheeses of the random winding type, wherein the workstations of an automatic cheese winder comprise a winding device with a yarn guide drum and a creel, both supported in an axially shiftable relation to each other, the creel holding the cheese in a rotatable manner and the yarn guide drum driving the cheese through frictional engagement, a ribbon disturbance device and an edge displacement device. The ribbon disturbance device causes a slippage by a defined adjustment of the bearing pressure of the cheese on the yarn guide drum. Relative movements between the yarn guide drum and the creel are initiated in the area of ribbon winding zones which counteract a stroke change caused by the ribbon disturbance during the winding of the yarn onto the cheese.

11 Claims, 2 Drawing Sheets

METHOD AND DEVICE FOR PRODUCING RANDOM WINDING CHEESES

CROSS REFERENCE TO RELATED APPLICATION

This application claims the benefit of German Application DE P 10020664.6 filed Apr. 27, 2000, herein incorporated by reference.

BACKGROUND OF THE INVENTION

When winding cheeses, a distinction is basically made between two types of windings: a. precision winding, and b. random winding. With precision winding, there is a constant relationship between the number of bobbin revolutions and the speed of the yarn cross winding during the entire bobbin travel, so that the winding ratio remains the same during the entire winding process. The yarn crossing angle decreases with increasing bobbin diameter. With random winding, there is a fixed relationship between the velocity of the peripheral or circumferential surface of the bobbin and the speed of yarn cross winding. The yarn crossing angle is kept constant by this relationship, while the winding ratio, i.e. the number of bobbin turns per double lift, becomes smaller with increasing diameter.

The present invention relates to a method for producing cheeses of a random winding type, particularly in a winding machine having a yarn guide drum and a creel that are mounted to be axially shiftable relative to each other and a ribbon disturbance device such that the relative movement between the yarn guide drum and the creel when the cheese enters a ribbon winding zone counteracts a stroke change caused by the ribbon disturbance device.

Automatic cheese winders having winding heads with yarn guide drums mounted in an axially shiftable manner are known, e.g., in German Patent Publication DE 43 36 312 A1. The yarn guide drum is connected to a drive shaft that also comprises the rotor of the bobbin drive device. Moreover, this known winding device comprises an edge displacement mechanism with which the yarn guide drum can be axially moved back and forth in a reciprocating, traversing manner as required with a constant stroke length.

German Patent Publication DE 198 29 597 A1 describes a method of producing cross-wound cheeses in a "random" type of winding process. In order to avoid ribbon-like pattern windings the bearing pressure of the cheese on the yarn guide drum can be reduced and the cheese loaded at the same time with a braking moment. Thus, the angular velocity of the cheese is constantly detected and processed in a control device in such a manner that at or shortly before a ribbon winding zone is reached, the angular velocity of the cheese is lowered to a non-critical angular velocity by a defined adjusting of the bearing pressure with which the cheese rests on the yarn guide drum. A device for performing this method is disclosed in German Patent Publication DE 198 29 597 A1.

Cheeses produced in accordance with the previously described method are characterized by a clearly improved ribbon resolution as well as by a very good flow behavior even at high unwinding speeds in subsequent production processes.

However, the reduction of the bearing load of the cheese on the yarn guide drum in the ribbon winding zones results in a slight impairment of the visual appearance of such cheeses. In particular, as a result of the reduction of the bearing load in the ribbon winding zones, a slight reduction of the displacement width of the yarn traversed by the yarn guide drum (i.e., the stroke) can occur in these areas. Such a change in stroke becomes visible as rings on the ends of the bobbins of the cheeses.

SUMMARY OF THE INVENTION

It is accordingly an object of the present invention to improve the known devices for random winding in order to overcome the disadvantages discussed above and manufacture cheeses in which the external appearance corresponds to their high manufacturing quality.

The objective is achieved by the present invention which produces a cheese with the desired visual appearance by using a winding station having a yarn guide drum and a creel mounted in an axially shiftable manner relative to each other and a ribbon disturbance device such that when a cheese enters a ribbon winding zone, relative movements between the yarn guide drum and the creel counteracts a stroke change caused by the ribbon disturbance device.

The method of the present invention has the particular advantage that the stroke change occurring in the ribbon winding zones by a ribbon disturbance device during the placement of yarn windings is immediately compensated by the simultaneous introduction of a relative movement between the yarn guide drum and the creel.

A preferred embodiment of the present invention provides that the stroke losses occurring on account of the ribbon disturbance process during the placement of yarn windings are compensated in a simple manner by an axial oscillation of the yarn guide drum with an adjustable amplitude. This assures that the cheeses produced have neither rings nor other optical impairments on their bobbin flanks.

Preferably, the oscillation of the yarn guide drum takes place simultaneously with the slippage regulation causing the ribbon disturbance. Thus, as soon as the drive device for the creel lift-off device is activated by the winding-head computer to reduce the bearing pressure between the cheese and the yarn guide drum, the drive for axial displacement, or oscillation, of the yarn guide drum, is automatically activated.

In addition to the frequency of the oscillation, the amplitude of the oscillation of the yarn guide drum is very important for an unobjectionable bobbin flank of the cheese. Since both the frequency and the optimum amplitude of the oscillation are a function of different bobbin parameters, e.g., the yarn material, the bobbin hardness, etc., it is preferable if both the frequency and also the amplitude of the oscillation can be adjusted in a defined manner.

The frequency of the oscillation is relatively low, e.g., between about 0.1 and about 3 hertz with about 0.5 hertz being especially advantageous.

Since the magnitude of the amplitude of the oscillation is very significant for the later appearance of the bobbin flank of the cheese, the amplitude is preferably selected to reliably assure that the stroke loss resulting from the ribbon disturbance is regained during the later traversing of the yarn.

The yarn guide drum oscillation in accordance with the present invention occurs independently of the operation of a standard edge displacement device of the winding head.

In a preferred embodiment in which the standard edge displacement device is already in operation at the winding head, a superimposing of the standard edge displacement motion and the yarn-guide-drum oscillation occurs in accordance with the present invention. Hence, the amplitude of the standard edge displacement motion is increased by the amplitude of the yarn guide drum oscillation.

In the preferred embodiment, a stepping motor which drives the edge displacement device is programmed so that it can operate continuously in one direction or in a reversing manner during which the angle of rotation of the stepping motor can be adjusted in a defined manner. Thus, the present invention provides a simple way to adjust the frequency as well as the magnitude of the amplitude of the oscillation of the yarn guide drum in a defined manner without having to expand the hardware of the winding head, which is associated as a rule with not-insignificant expense.

Further details, features and advantages of the present invention will be understood from the following disclosure of exemplary embodiments with reference to the accompanying drawings.

DETAILED DESCRIPTION OF THE PREFERRED EMBODIMENTS

Figure 1:
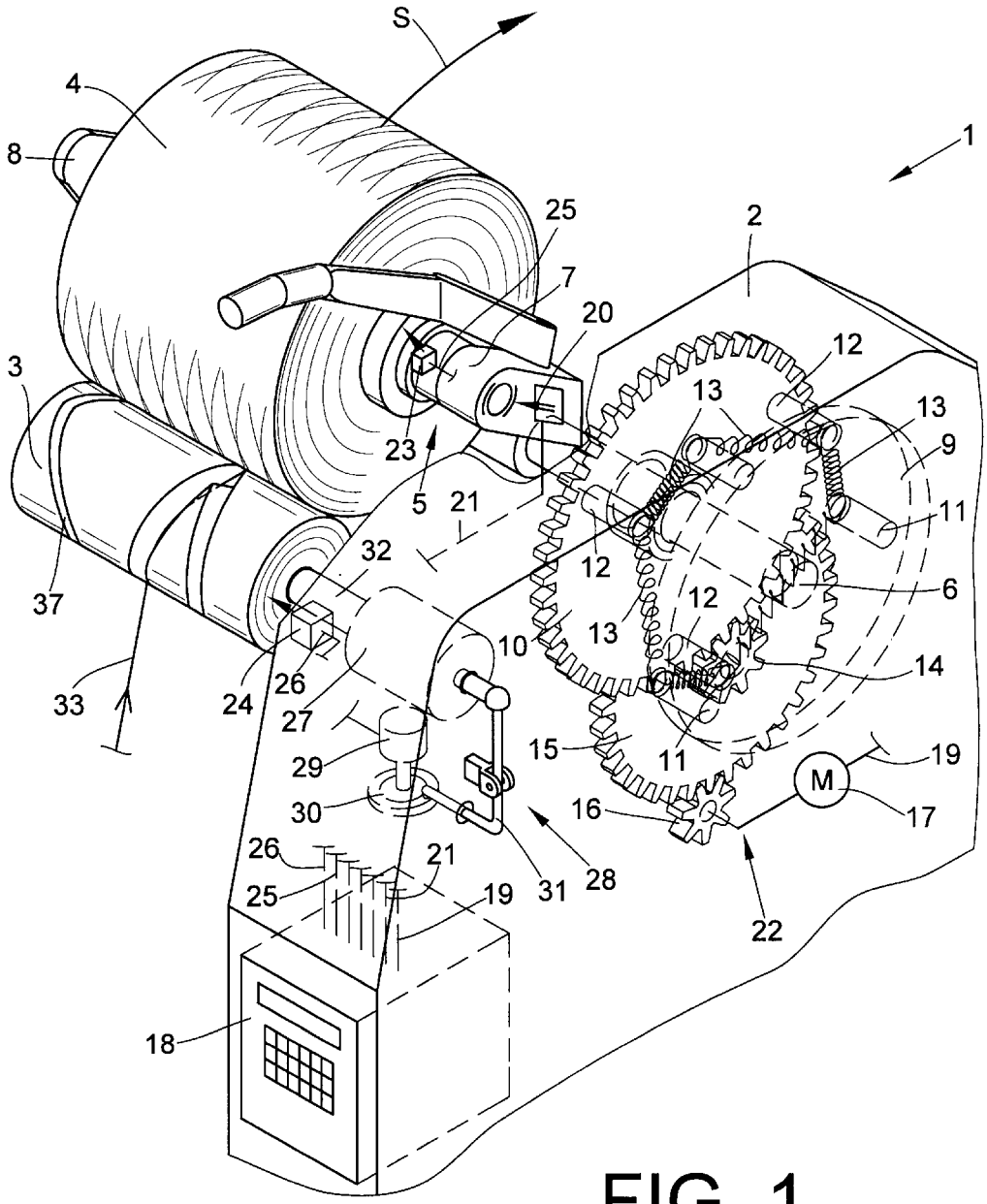
FIG. 1 is a perspective view of a workstation of an automatic cheese winder illustrating a device required for carrying out the method in accordance with a preferred embodiment of the present invention.

FIG. 1 shows winding head housing 2 of a workstation of an automatic cheese winder which workstation is designated in its entirety by reference numeral 1. Workstation 1 comprises devices for carrying out a ribbon disturbance process, a standard edge displacement as well as a yarn-guide-drum oscillation in accordance with the present invention. In particular, a yarn-guide drum 3 driven by electromotor 27 is mounted in an axially shiftable manner in winding head housing 2 of workstation 1. Cheese 4 is held in creel 5 that is connected to pivot shaft 6 in such a manner that they rotate in unison. Pivot shaft 6 is arranged parallel to the axis of yarn guide drum 3 and mounted on winding head housing 2 in a limited pivotable manner, as indicated by arrow S. Yarn guide drum 3 drives cheese 4 via friction.

Creel 5 comprises, as is customary, two bobbin arms 7, 8 provided with rotatably mounted bobbin plates. A tube, or bobbin, is held between the bobbin plates, a yarn 33 is wound onto the tube in order to form cheese 4. At least one of bobbin arms 7, 8 can be pivoted away with the bobbin plate to the side away from the cheese in a manner not shown in detail, so that a full cheese can be removed from creel 5 and an empty tube can be inserted. The ribbon disturbance device is essentially a torque transmitter, designed as creel lifting device 22, which controls pivot shaft 6 of creel 5. The torque transmitter includes a connection disk 9 connected to pivot shaft 6 in such a manner that connection disk 9 and pivot shaft 6 rotate in unison, and gear 10 pivotably mounted coaxially to pivot shaft 6. Connection disk 9 is provided with connection bolts 11 facing toward gear 10. Corresponding connection bolts 12 are provided on gear 10 and face toward connection disk 9. Identical spring elements 13 in the form of spiral springs are inserted between connection bolts 11 of connection disk 9 and between connection bolts 12 of gear 10 and are used as transmission elements that are opposingly deformed upon a relative rotation of gear 10 and connection disk 9.

Gear 10 meshes with pinion 14 of a stepdown gearing whose outer rim 15 is connected via drive pinion 16 to stepping motor 17. Since drive pinion 16, outer rim 15 and pinion 14 are rotatably mounted on winding head housing 2, and stepping motor 17 is fixedly attached to the winding head housing 2, then every rotational movement of stepping motor 17 is transmitted via the stepdown gearing with a ratio, for example, of about 1:25, to gear 10. Stepping motor 17, adjustable to individual steps of, for example, approximately 1.8 degrees, is controlled by winding head computer 18 and is thus capable of executing a predetermined number of rotations or a predetermined number of individual steps to produce a torque on creel 5. The change in the torque produced on creel 5 changes the contact pressure of cheese 4 on yarn guide drum 3, resulting in an adjustable contact pressure.

The angular velocity of cheese 4 and the angular velocity of yarn guide drum 3, determined by the number of revolutions, are continuously monitored by sensors 23 and 24, that are connected via corresponding signal leads 25, 26 to winding head computer 18, which controls the contact pressure between cheese 4 and yarn guide drum 3. Using the data collected from sensors 23, 24 and known construction data of the winding machine, the winding head computer 18 can continuously calculate the winding parameters of cheese 4.

When the diameter of cheese 4 approaches a ribbon winding zone, that is, an area in which the number of revolutions of the yarn guide drum is, for example, a whole-number multiple of the number of revolutions of the cheese in slippage-free operation, a slippage regulation is initiated that causes a ribbon disturbance. In particular, the angular velocity of cheese 4 is reduced from an instantaneous angular velocity calculated for the diameter of cheese 4 to a lower angular velocity.

The reduction of the angular velocity of cheese 4 and the continued retention of the lower angular velocity occurs by simultaneously applying a constant braking moment to cheese 4 by a bobbin brake 20 which is connected to winding head computer 18 by signal lead 21, and reducing the bearing pressure between cheese 4 and yarn guide drum 3 by a defined lifting of creel 5. The desired number of revolutions of cheese 4 can be exactly regulated by appropriately raising or reducing this bearing pressure by having gear 10 rotated by stepping motor 17 into a position corresponding to a calculated bearing pressure of cheese 4 on yarn guide drum 3. Thus, ribbon windings on cheese 4 can be avoided. A control program in winding head computer 18 regulates the bearing pressure as a function of the bobbin travel of the cheese 4 and/or of the diameter of cheese 4 by adjusting stepping motor 17. The control program calculates the required position of stepping motor 17, expressed in positive or negative steps, based on the previously described sensor data fed to the winding head computer 18 during the entire bobbin travel.

Yarn guide drum 3, driven by reversible electromotor 27, is mounted so that it can shift axially relative to creel 5 by edge displacement mechanism 28, as has already been discussed. Such an edge displacement mechanism is disclosed in German Patent Publication DE 43 36 312 A1.

Edge displacement mechanism 28 includes stepping motor 29, connected via control lead 19 to winding head computer 18, eccentric plate 30 and lifting element 31 which acts on drive shaft 32 of yarn guide drum 3. Eccentric plate 30 is rotated in accordance with the adjustment angle of stepping motor 29 and pivots lifting element 31, preferably designed as a double lever, which axially shifts drive shaft 32 and yarn guide drum 3 therewith against the force of a spring element (not shown).

Stepping motor 29 is programmed to be operated not only in a continuously rotating manner, as is customary in standard edge displacement devices, but also in an alternating manner by presettable degrees of angle. Thus, the adjustment angle of stepping motor 29 and the resulting amplitude of the oscillations of yarn guide drum 3 can be adjusted in a defined manner in both directions. The eccentricity of the eccentric plate 30 is preferably selected so that both the maximum amplitude of the standard edge displacement movement as well as the maximum amplitude of the yarn-guide-drum oscillation can be obtained.

A winding station having the devices discussed above can be operated by the following method in accordance with the present invention to avoid ribbon windings. During the winding process a yarn 33 drawn off from a presenting bobbin (not shown) is backwound to a large-volume cheese 4. As is customary, yarn 33 is checked during the backwinding by a yarn cleaner (not shown) for any yarn errors and cleaned up, if necessary. Cleaned yarn 33 is subsequently wound by yarn guide drum 3 in crossing layers onto a tube, or bobbin, rotatably supported in creel 5, to form cheese 4. Cheese 4 rests against yarn guide drum 3 with a presettable bearing pressure. Thus, yarn guide drum 3, in whose yarn guide groove 37 yarn 33 slides, drives the tube or cheese 4 by frictional engagement.

When cheese 4 has attained a diameter at which the creation of a ribbon formation is expected, a slippage regulation is initiated by winding head computer 18, activating creel-lifting device 22 and bobbin brake 20. Creel lifting device 22 assures that the bearing pressure of cheese 4 of yarn guide drum 3 is reduced, which results in a reduction of the angular velocity of cheese 4, thereby creating a slippage between cheese 4 and yarn guide drum 3. The number of revolutions of cheese 4 is lowered as a result thereof to a value that is non-critical for the cheese diameter present.

Figure 2:
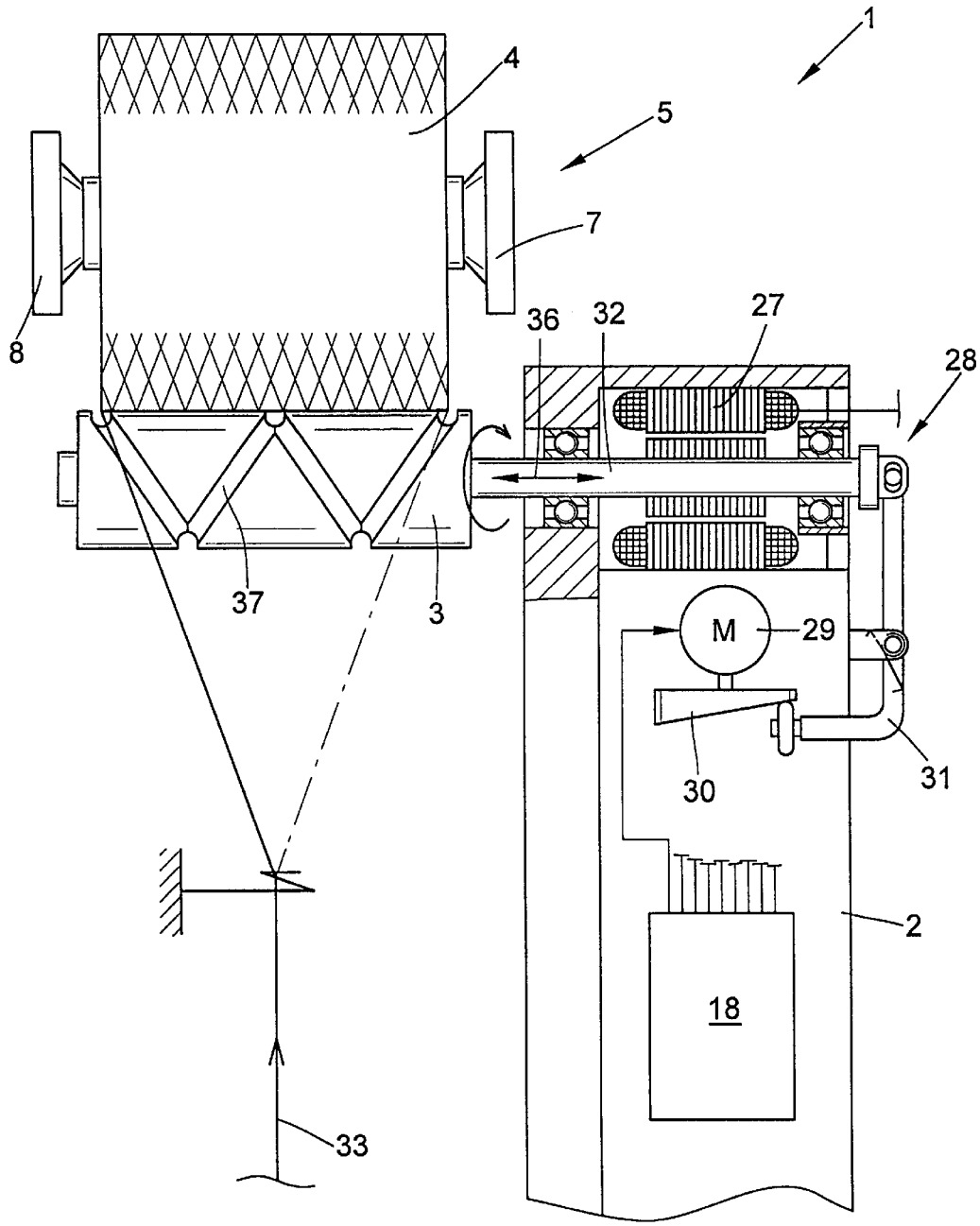
FIG. 2 shows a front view of the workstation of FIG. 1 in partial section.

Since the reduction of the bearing pressure also results in a slight loss of stroke when the yarn is placed, edge displacement mechanism 28 is activated at the same time in the manner in accordance with the present invention. Stepping motor 29 is controlled via winding head computer 18 such that it moves back and forth in an alternating manner by an adjustable angle of rotation and oscillates bearing shaft 32 via eccentric plate 30 and lifting element 31, causing yarn guide drum 3 to oscillate axially, as is indicated in FIG. 2 by double arrow 36. The stroke losses produced during the traversing of the yarn due to the lesser bearing pressure of cheese 4 are immediately compensated by this oscillation 36 of the yarn guide drum. The frequency and amplitude of the oscillation of the yarn guide drum 3 can be adjusted by an appropriate controlling of stepping motor 29.

As has already been indicated above, yarn-guide-drum oscillation 36 in accordance with the present invention occurs either in addition to the standard operation of the edge displacement mechanism 28 or when the standard edge displacement mechanism 28 of the particular winding head is not engaged. When yarn-guide-drum oscillation 36 in accordance with the present invention occurs in addition to the standard operation of the edge displacement mechanism 28, a superimposing of the amplitudes of the two axial yarn-guide-drum movements occurs in some instances. In any case, the yarn-guide-drum oscillation 36 in accordance with the present invention assures that only high-quality cheeses are produced with respect to the behavior of the operating sequence and the appearance. Hence, the cheeses produced in accordance with the method of the present invention exhibit in every instance unblemished bobbin flanks without grooves or other visual impairments.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method of producing cheeses of a random winding type in a winding machine having a yarn guide drum and a creel that are mounted in an axially shiftable relation to each other, and a ribbon disturbance device, the method comprising initiating relative movements between the yarn guide drum and the creel in ribbon winding zones such that the movements counteract a stroke change caused by a ribbon disturbance during a traversing of the yarn.

2. The method according to claim 1, wherein the yarn guide drum is subjected in the ribbon winding zones to an axial oscillation that counteracts the stroke change.

3. The method according to claim 2, wherein the oscillation of the yarn guide drum occurs simultaneously with a slippage regulation which causes the ribbon disturbance.

4. The method according to claim 2, wherein the oscillation of the yarn guide drum has a frequency of oscillation approximately between 0.1 and 3 hertz.

5. The method according to claim 4, wherein the frequency of oscillation is about 0.5 hertz.

6. The method according to claim 2, wherein the oscillation of the yarn guide drum has an amplitude approximately equal to a stroke loss resulting from the ribbon disturbance during the traversing of the yarn.

7. The method according to claim 6, wherein the amplitude of the oscillation of the yarn guide drum is adjustable by changing an adjustment angle of a stepping motor driving an edge displacement mechanism.

8. The method according to claim 2, wherein the oscillation of the yarn guide drum occurs in addition to operation of an edge displacement mechanism.

9. The method according to claim 2, wherein the oscillation of the yarn guide drum occurs independently of operation of an edge displacement mechanism.

10. A device for carrying out the method according to claim 1, wherein an edge displacement mechanism comprises a stepping motor controlled by a winding head computer such that the stepping motor travels alternately back and forth, the stepping motor having an adjustable angle of rotation.

11. The device according to claim 10, wherein an oscillation of the yarn guide drum has an amplitude which is adjusted by changing the adjustment angle of rotation of the stepping motor of the edge displacement mechanism.

* * * * *